US006161718A

United States Patent [19]

Monbo

[11] Patent Number: 6,161,718

[45] Date of Patent: Dec. 19, 2000

[54] UTENSIL BASKET

[76] Inventor: Ophelia B. Monbo, 65 Fennington Cir., Owings Mills, Md. 21117

[21] Appl. No.: 09/267,006

[22] Filed: Mar. 11, 1999

[51] Int. Cl.[7] ..... B65D 7/00

[52] U.S. Cl. ..... 220/486; 220/23.87; 220/488; 220/771

[58] Field of Search ..... 220/486, 487, 220/488, 495, 676, 771, 528, 23.87; 206/557

[56] References Cited

U.S. PATENT DOCUMENTS

| | | | |
|---|---|---|---|
| 2,613,804 | 10/1952 | Hughes | 220/23.87 X |
| 3,278,074 | 10/1966 | Yamazaki | 220/771 X |
| 3,282,460 | 11/1966 | Boznango | 220/486 |
| 4,192,432 | 3/1980 | Jordan | 206/557 X |
| 4,478,349 | 10/1984 | Haverland, Jr. et al. | 220/771 X |
| 5,431,294 | 7/1995 | Stottmann et al. | 220/488 X |
| 5,881,906 | 3/1999 | Rogers et al. | 220/488 X |

*Primary Examiner*—Steven Pollard

[57] ABSTRACT

A utensil basket for holding and organizing utensils. The utensil basket includes a bottom wall with a perimeter wall upwardly extending around the bottom wall. The perimeter wall comprises spaced apart first and second end walls and spaced apart first and second side walls extending between the end walls. A longitudinal dividing wall is upwardly extended from the bottom wall between the end walls. Spaced apart first, second, and third lateral dividing walls are upwardly extended from the bottom wall between the longitudinal dividing wall and the second side wall. A secondary dividing wall is upwardly extended from the bottom wall between the first lateral dividing wall and the second end wall through the second and third lateral dividing walls.

13 Claims, 2 Drawing Sheets

UTENSIL BASKET

BACKGROUND OF THE INVENTION

1. Field of the Invention

The present invention relates to utensil baskets and more particularly pertains to a new utensil basket for holding and organizing utensils.

2. Description of the Prior Art

The use of utensil baskets is known in the prior art. More specifically, utensil baskets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 4,834,125 by Insalaco; U.S. Pat. No. 4,058,233 by Frangos; EPO Patent No. EP 0 385 877 A1 by Clavel et al.; U.S. Pat. No. 3,960,290 by Yake et al.; U.S. Pat. No. 1,487,942 by Hines et al.; EPO Patent No. EP 0 448 531 A1 by Wrangberth; and U.S. Pat. No. 3,182,854 by Geller.

While these devices fulfill their respective, particular objectives and requirements, the aforementioned patents do not disclose a new utensil basket. The inventive device includes a bottom wall with a perimeter wall upwardly extending around the bottom wall. The perimeter wall comprises spaced apart first and second end walls and spaced apart first and second side walls extending between the end walls. A longitudinal dividing wall is upwardly extended from the bottom wall between the end walls. Spaced apart first, second, and third lateral dividing walls are upwardly extended from the bottom wall between the longitudinal dividing wall and the second side wall. A secondary dividing wall is upwardly extended from the bottom wall between the first lateral dividing wall and the second end wall through the second and third lateral dividing walls.

In these respects, the utensil basket according to the present invention substantially departs from the conventional concepts and designs of the prior art, and in so doing provides an apparatus primarily developed for the purpose of holding and organizing utensils.

SUMMARY OF THE INVENTION

In view of the foregoing disadvantages inherent in the known types of utensil baskets now present in the prior art, the present invention provides a new utensil basket construction wherein the same can be utilized for holding and organizing utensils.

The general purpose of the present invention, which will be described subsequently in greater detail, is to provide a new utensil basket apparatus and method which has many of the advantages of the utensil baskets mentioned heretofore and many novel features that result in a new utensil basket which is not anticipated, rendered obvious, suggested, or even implied by any of the prior art utensil baskets, either alone or in any combination thereof.

To attain this, the present invention generally comprises a bottom wall with a perimeter wall upwardly extending around the bottom wall. The perimeter wall comprises spaced apart first and second end walls and spaced apart first and second side walls extending between the end walls. A longitudinal dividing wall is upwardly extended from the bottom wall between the end walls. Spaced apart first, second, and third lateral dividing walls are upwardly extended from the bottom wall between the longitudinal dividing wall and the second side wall. A secondary dividing wall is upwardly extended from the bottom wall between the first lateral dividing wall and the second end wall through the second and third lateral dividing walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new utensil basket apparatus and method which has many of the advantages of the utensil baskets mentioned heretofore and many novel features that result in a new utensil basket which is not anticipated, rendered obvious, suggested, or even implied by any of the prior art utensil baskets, either alone or in any combination thereof.

It is another object of the present invention to provide a new utensil basket which may be easily and efficiently manufactured and marketed.

It is a further object of the present invention to provide a new utensil basket which is of a durable and reliable construction.

An even further object of the present invention is to provide a new utensil basket which is susceptible of a low cost of manufacture with regard to both materials and labor, and which accordingly is then susceptible of low prices of sale to the consuming public, thereby making such utensil basket economically available to the buying public.

Still yet another object of the present invention is to provide a new utensil basket which provides in the apparatuses and methods of the prior art some of the advantages thereof, while simultaneously overcoming some of the disadvantages normally associated therewith.

Still another object of the present invention is to provide a new utensil basket for holding and organizing cooking and eating utensils.

Yet another object of the present invention is to provide a new utensil basket which includes a bottom wall with a perimeter wall upwardly extending around the bottom wall. The perimeter wall comprises spaced apart first and second end walls and spaced apart first and second side walls extending between the end walls. A longitudinal dividing wall is upwardly extended from the bottom wall between the end walls. Spaced apart first, second, and third lateral dividing walls are upwardly extended from the bottom wall between the longitudinal dividing wall and the second side wall. A secondary dividing wall is upwardly extended from the bottom wall between the first lateral dividing wall and the second end wall through the second and third lateral dividing walls.

Still yet another object of the present invention is to provide a new utensil basket that may be used to hold and organize utensils on a kitchen counter so that the utensils are easily retrievable by a user when needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
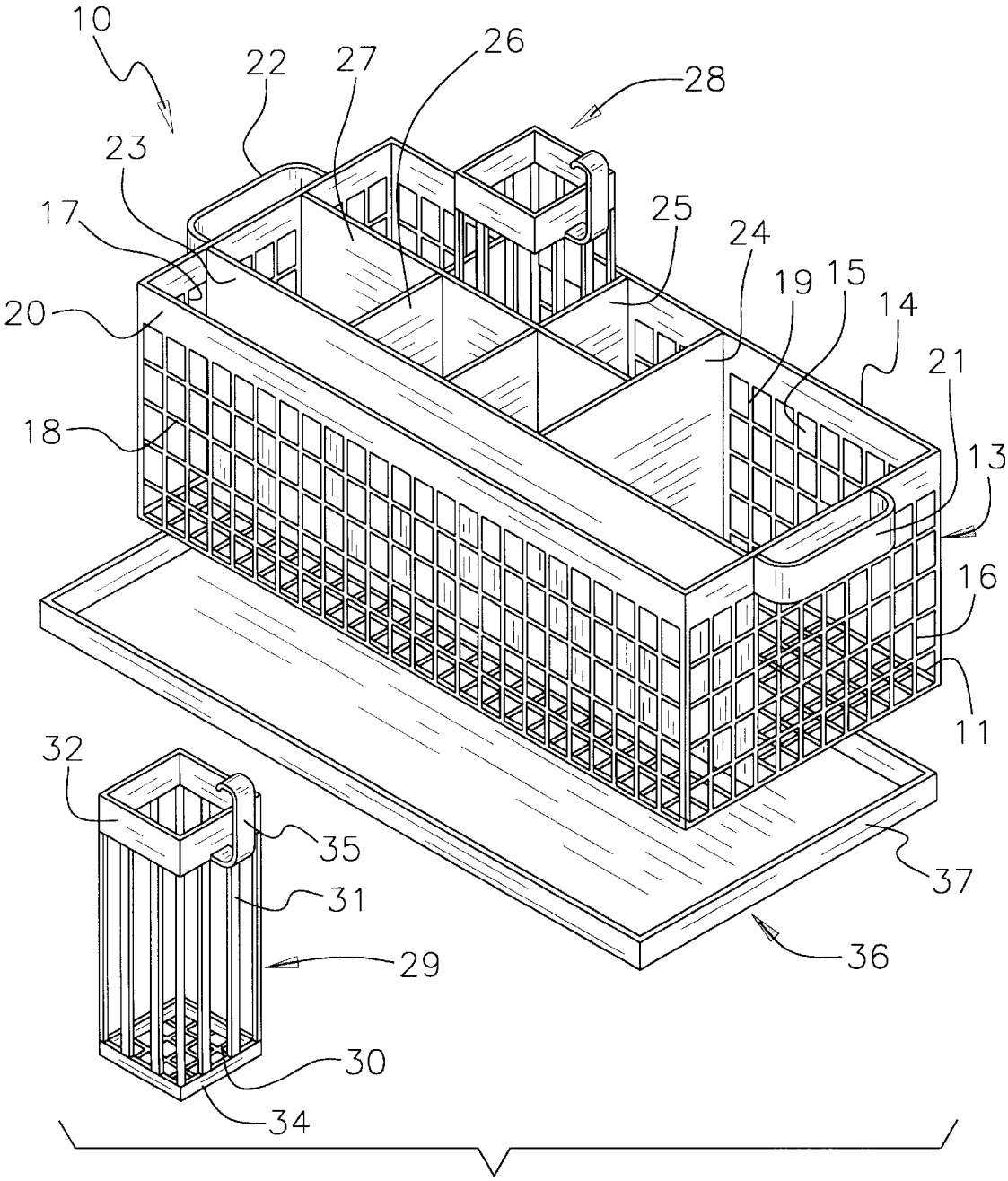
FIG. 1 is a schematic exploded perspective view of a new utensil basket according to the present invention.
Figure 2:
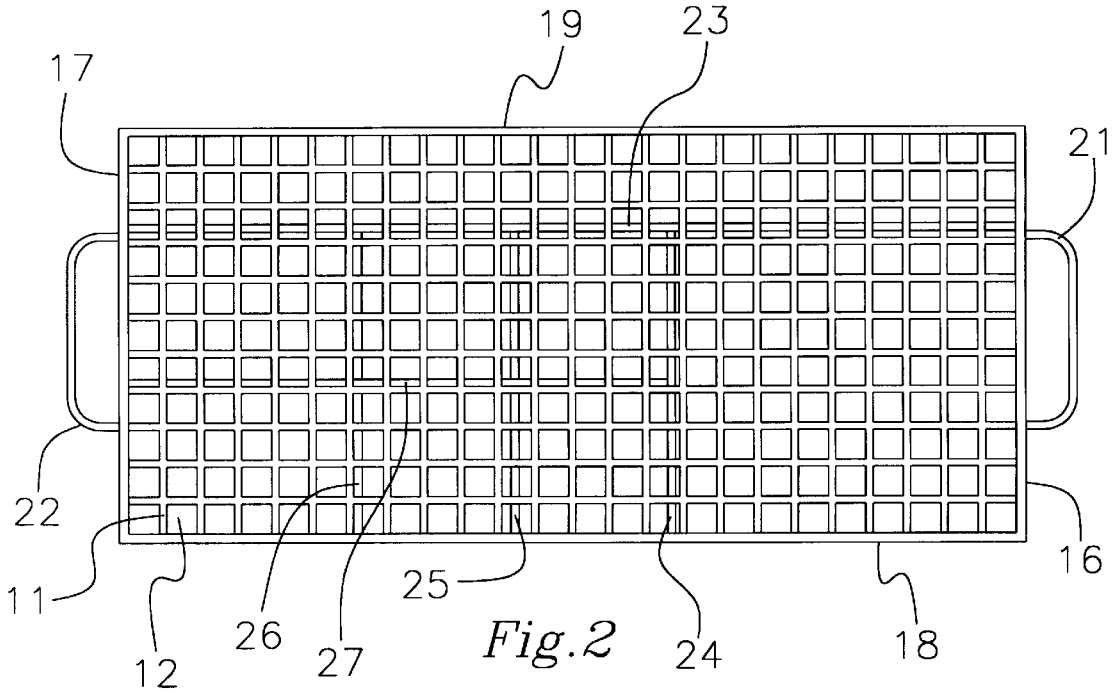
FIG. 2 is a schematic bottom view of the present invention.
Figure 3:
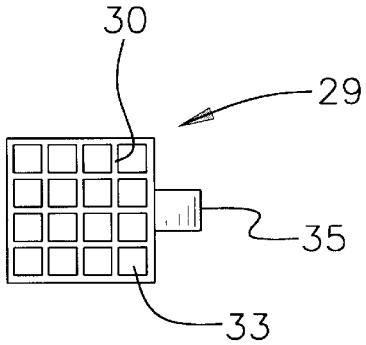
FIG. 3 is a schematic bottom view of an insert basket.

With reference now to the drawings, and in particular to FIGS. 1 through 3 thereof, a new utensil basket embodying the principles and concepts of the present invention and generally designated by the reference numeral 10 will be described.

As best illustrated in FIGS. 1 through 3, the utensil basket 10 generally comprises a bottom wall with a perimeter wall upwardly extending around the bottom wall. The perimeter wall comprises spaced apart first and second end walls and spaced apart first and second side walls extending between the end walls. A longitudinal dividing wall is upwardly extended from the bottom wall between the end walls. Spaced apart first, second, and third lateral dividing walls are upwardly extended from the bottom wall between the longitudinal dividing wall and the second side wall. A secondary dividing wall is upwardly extended from the bottom wall between the first lateral dividing wall and the second end wall through the second and third lateral dividing walls.

In use, the utensil basket 10 is designed for holding and organizing utensils. In closer detail, the utensil basket comprises a generally rectangular and substantially planar latticed bottom wall 11 having a generally rectangular outer perimeter and a plurality of generally rectangular apertures 12 therethrough arranged in a gridlike fashion. A latticed perimeter wall 13 upwardly extends around the outer perimeter of the bottom wall. The perimeter wall has a generally rectangular upper edge 14 and a plurality of generally apertures 15 therethrough arranged in a grid-like fashion. Preferably, the upper edge of the perimeter wall and the bottom wall lie in substantially parallel planes to one another.

The perimeter wall comprises spaced apart first and second latticed end walls 16,17 and spaced apart first and second latticed side walls 18,19 extending between the end walls. Preferably, the end walls lie in substantially parallel planes to one another. In this preferred embodiment, the side walls lie in substantially parallel planes to one another substantially perpendicular to the planes of the end walls. The end and side walls of the perimeter wall preferably lie in planes extending substantially perpendicular to a plane in which the bottom wall lies.

The bottom wall has a length defined between the end walls and a width defined between the side walls. The perimeter wall has a height defined between the bottom wall and the upper edge of the perimeter wall. Preferably, the length of the bottom wall is greater than the width of the bottom wall and the width of the bottom wall is greater than the height of the perimeter wall. In an ideal illustrative embodiment, the length of the bottom wall is about 13 ½ inches, the width of the bottom wall is about 7 ¾ inches, and the height of the perimeter wall is about 5 ½ inches. In this embodiment, the apertures of the walls each have a dimension of about ½ inch by ½ inch.

The perimeter wall preferably has a reinforcing strip 20 extending therearound adjacent the upper edge of the perimeter wall. The reinforcing strip of the perimeter wall has a width defined substantially parallel to the height of the perimeter wall. Preferably, the height of the perimeter wall is at least five times greater than the width of the reinforcing strip of the perimeter wall. Ideally, the width of the reinforcing strip of the perimeter wall is about ½ inch.

The perimeter wall has a pair of outwardly extending generally U-shaped end handles 21,22. The end handles are coupled to the reinforcing strip of the perimeter wall. One of the end handles is positioned on one of the end walls and the other end handle is positioned on the other end wall.

A longitudinal dividing wall 23 is upwardly extended from the bottom wall between the end walls. The longitudinal dividing wall is spaced apart from each of the side walls. Preferably, the longitudinal dividing wall is positioned closer to the first side wall than to the second side wall. Ideally, the distance between the longitudinal dividing wall and the second side wall is about twice the distance between the longitudinal dividing wall the first side wall. The longitudinal dividing wall and the side walls preferably lie in generally parallel planes to one another while the longitudinal dividing wall preferably lies in a plane extending substantially perpendicular to the planes of the end walls and the plane of the bottom wall.

Spaced apart first, second, and third lateral dividing walls 24,25,26 are upwardly extended from the bottom wall between the longitudinal dividing wall and the second side wall. The lateral dividing walls preferably lie in planes substantially parallel to one another and the end walls and substantially perpendicular to the side walls and the bottom wall. The first lateral dividing wall 24 is positioned towards the first end wall. The second lateral dividing wall 25 is positioned between the first lateral dividing wall and the second end wall. The third lateral dividing wall 26 is positioned between the second lateral dividing wall and the second end wall so that second lateral dividing wall is interposed between the first and third lateral dividing walls.

Preferably, the second lateral wall is about equidistantly spaced between the first and third lateral walls. In this preferred embodiment, the third lateral wall is spaced a distance from the second end wall greater than a distance between the second and third lateral walls. The first lateral wall and the first end wall is preferably spaced apart a distance greater than the distance between the third lateral wall and the second end wall.

A secondary dividing wall 27 upwardly extends from the bottom wall between the first lateral dividing wall and the second end wall through the second and third lateral dividing walls. The secondary dividing wall is positioned between and spaced apart from the longitudinal dividing wall and the second side wall. The secondary dividing wall, the longitudinal dividing wall and the side walls preferably lie substantially parallel planes to one another. The secondary dividing wall preferably lies in a plane extending substantially perpendicular to the lateral dividing walls, the end walls, and the bottom wall.

The first, second, and third lateral dividing walls and the secondary dividing wall define four generally equal sized compartments therebetween. At least one insert basket 28,29 is inserted into one of the compartment defined between first, second, and third lateral dividing walls and the secondary dividing wall. Each insert basket comprises a generally rectangular latticed bottom panel 30, a plurality of spaced apart and substantially parallel elongate side strips 31 upwardly extending substantially perpendicularly from an outer perimeter of the bottom panel, and a generally rectangular open upper band 32 coupled to upper ends of the side strips.

The bottom panel of the insert basket has a generally rectangular outer perimeter and a plurality of generally rectangular apertures 33 therethrough. Preferably, the bottom panel has a generally rectangular reinforcing lip 34 upwardly extending around the outer perimeter of the bottom panel with the side strips extending from the reinforcing lip of the bottom panel. The side strips of the insert basket are arranged along the outer perimeter of the bottom panel and are preferably spaced apart at generally equal intervals along the outer perimeter of the bottom panel.

Each insert basket a generally C-shaped lifting handle 35 having generally opposing upper and lower ends defining a break therebetween. The lower end of the lifting handle is coupled to the upper band of the insert basket so that the upper end of the lifting handle is positioned above the upper band of the insert basket. The insert basket has a height defined between the bottom panel and the upper band. The height of the insert basket is greater than the height of the perimeter wall such that the upper band of the insert basket is positioned about the upper edge of the perimeter wall when the insert basket is inserted into one of the four compartments and the bottom panel is resting on the bottom wall.

In an ideal embodiment, a generally rectangular tray 36 is provided having a generally rectangular outer perimeter and an upwardly extending lip 37 extending around the outer perimeter of the tray. The bottom wall is rested on the tray such that the lip of the tray is disposed around the bottom of the perimeter wall.

Ideally, the utensil basket, the insert baskets and the tray each comprise a dishwasher safe plastic material help prevent scratching of surfaces with the invention and for preventing corrosion and rust.

The dividing walls divide the utility basket into a plurality of compartments designed for holding cooking and eating utensils therein. The tray is designed for protecting a resting surface such as a countertop or tabletop from damage from contact with the utensils in the utensil basket.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A utensil basket for holding and organizing utensils, comprising:

a bottom wall having an outer perimeter and a plurality of apertures therethrough;

a perimeter wall upwardly extending around said outer perimeter of said bottom wall, said perimeter wall having an upper edge and a plurality of apertures therethrough;

said perimeter wall comprising spaced apart first and second end walls and spaced apart first and second side walls extending between said end walls;

a longitudinal dividing wall being upwardly extended from said bottom wall between said end walls;

spaced apart first, second, and third lateral dividing walls being upwardly extended from said bottom wall between said longitudinal dividing wall and said second side wall;

said first lateral dividing wall being positioned towards said first end wall;

said second lateral dividing wall being positioned between said first lateral dividing wall and said second end wall;

said third lateral dividing wall being positioned between said second lateral dividing wall and said second end wall such that second lateral dividing wall is interposed between said first and third lateral dividing walls; and a secondary dividing wall upwardly extending from said bottom wall between said first lateral dividing wall and said second end wall through said second and third lateral dividing walls;

wherein said first, second, and third lateral dividing walls and said secondary dividing wall define four compartments therebetween, wherein at least one insert basket is inserted into one of said compartment defined between first, second, and third lateral dividing walls and said secondary dividing wall;

wherein each insert basket comprises a bottom panel, a plurality of spaced apart elongate side strips upwardly extending from said bottom panel, and a generally upper band coupled to upper ends of said side strips;

wherein a generally C-shaped lifting handle has upper and lower ends, said lower end of said lifting handle being coupled to said upper band of said insert basket, said upper end of said lifting handle being positioned above said upper band of said insert basket.

2. The utensil basket of claim 1, wherein said perimeter wall has a reinforcing strip extending therearound adjacent said upper edge of said perimeter wall.

3. The utensil basket of claim 2, wherein said perimeter wall has a pair of outwardly extending generally U-shaped end handles, said end handles being coupled to said reinforcing strip of said perimeter wall.

4. The utensil basket of claim 3, wherein one of said end handles is positioned on one of said end walls, and wherein the other of said end handles is positioned on the other end wall.

5. The utensil basket of claim 1, wherein said bottom panel has a generally rectangular reinforcing lip upwardly extending therearound, and wherein said side strips are extended from said reinforcing lip of said bottom panel.

6. The utensil basket of claim 1, further comprising a tray having a generally an outer perimeter and an upwardly extending lip extending around said outer perimeter of said tray, said bottom wall being rested on said tray such that said lip of said tray is disposed around said perimeter wall.

7. A utensil basket for holding and organizing utensils, comprising:

a generally rectangular latticed bottom wall having an generally rectangular outer perimeter and a plurality of generally rectangular apertures therethrough;

a latticed perimeter wall upwardly extending around said outer perimeter of said bottom wall, said perimeter wall having a generally rectangular upper edge and a plurality of generally apertures therethrough;

said upper edge of said perimeter wall and said bottom wall lying in substantially parallel planes to one another;

said perimeter wall comprising spaced apart first and second latticed end walls and spaced apart first and second latticed side walls extending between said end walls;

said end walls lying in substantially parallel planes to one another, said side walls lying in substantially parallel planes to one another substantially perpendicular to said planes of said end walls;

said end and side walls of said perimeter wall lying in planes extending substantially perpendicular to said bottom wall;

said bottom wall having a length defined between said end walls and a width defined between said side walls;

said perimeter wall having a height defined between said bottom wall and said upper edge of said perimeter wall;

wherein said length of said bottom wall is greater than said width of said bottom wall, and wherein said width of said bottom wall is greater than said height of said perimeter wall;

said perimeter wall having a reinforcing strip extending therearound adjacent said upper edge of said perimeter wall;

said reinforcing strip of said perimeter wall having a width defined substantially parallel to said height of said perimeter wall, wherein said height of said perimeter wall is at least five times greater than said width of said reinforcing strip of said perimeter wall;

said perimeter wall having a pair of outwardly extending generally U-shaped end handles, said end handles being coupled to said reinforcing strip of said perimeter wall;

one of said end handles being positioned on one of said end walls, the other of said end handles being positioned on the other end wall;

a longitudinal dividing wall being upwardly extended from said bottom wall between said end walls, said longitudinal dividing wall being spaced apart from each of said side walls, said longitudinal dividing wall being positioned closer to said first side wall than to said second side wall;

said longitudinal dividing wall and said side walls lying in generally parallel planes to one another, said longitudinal dividing wall lying in a plane extending substantially perpendicular to said end walls and said bottom wall;

spaced apart first, second, and third lateral dividing walls being upwardly extended from said bottom wall between said longitudinal dividing wall and said second side wall;

said lateral dividing walls lying in planes substantially parallel to one another and said end walls and substantially perpendicular to said side walls and said bottom wall;

said first lateral dividing wall being positioned towards said first end wall;

said second lateral dividing wall being positioned between said first lateral dividing wall and said second end wall;

said third lateral dividing wall being positioned between said second lateral dividing wall and said second end wall such that second lateral dividing wall is interposed between said first and third lateral dividing walls;

said second lateral wall being about equidistantly spaced between said first and third lateral walls;

said third lateral wall being spaced a distance from said second end wall greater than a distance between said second and third lateral walls;

said first lateral wall and said first end wall being spaced apart a distance greater than said distance between said third lateral wall and said second end wall;

a secondary dividing wall upwardly extending from said bottom wall between said first lateral dividing wall and said second end wall through said second and third lateral dividing walls;

said secondary dividing wall being positioned between and spaced apart from said longitudinal dividing wall and said second side wall;

said secondary dividing wall, said longitudinal dividing wall and said side walls lying substantially parallel planes to one another;

said secondary dividing wall lying in a plane extending substantially perpendicular to said lateral dividing walls, said end walls, and said bottom wall;

said first, second, and third lateral dividing walls and said secondary dividing wall defining four compartments therebetween;

at least one insert basket being inserted into one of said compartment defined between first, second, and third lateral dividing walls and said secondary dividing wall;

each insert basket comprising a generally rectangular latticed bottom panel, a plurality of spaced apart and substantially parallel elongate side strips upwardly extending substantially perpendicularly from said bottom panel, and a generally rectangular open upper band coupled to upper ends of said side strips;

said bottom panel of said insert basket having a generally rectangular outer perimeter and a plurality of generally rectangular apertures therethrough;

said bottom panel having a generally rectangular reinforcing lip upwardly extending around said outer perimeter of said bottom panel, said side strips being extended from said reinforcing lip of said bottom panel;

said side strips of said insert basket being arranged along said outer perimeter of said bottom panel and spaced apart at generally equal intervals along said outer perimeter of said bottom panel;

a generally C-shaped lifting handle having upper and lower ends, said lower end of said lifting handle being coupled to said upper band of said insert basket, said upper end of said lifting handle being positioned above said upper band of said insert basket;

said insert basket having a height defined between said bottom panel and said upper band, said height of said insert basket being greater than said height of said perimeter wall such that said upper band of said insert basket is positioned about said upper edge of said perimeter wall; and a generally rectangular tray having a generally rectangular outer perimeter and an upwardly extending lip extending around said outer perimeter of said tray, said bottom wall being rested on said tray such that said lip of said tray is disposed around said perimeter wall.

8. A utensil basket for holding and organizing utensils, comprising:

a bottom wall having an outer perimeter and a plurality of apertures therethrough;

a perimeter wall upwardly extending around said outer perimeter of said bottom wall, said perimeter wall having an upper edge and a plurality of apertures therethrough;

said perimeter wall comprising spaced apart first and second end walls and spaced apart first and second side walls extending between said end walls;

a longitudinal dividing wall being upwardly extended from said bottom wall between said end walls;

spaced apart first, second, and third lateral dividing walls being upwardly extended from said bottom wall between said longitudinal dividing wall and said second side wall;

said first lateral dividing wall being positioned towards said first end wall;

said second lateral dividing wall being positioned between said first lateral dividing wall and said second end wall;

said third lateral dividing wall being positioned between said second lateral dividing wall and said second end wall such that second lateral dividing wall is interposed between said first and third lateral dividing walls; and a secondary dividing wall upwardly extending from said bottom wall between said first lateral dividing wall and said second end wall through said second and third lateral dividing walls;

wherein said dividing walls and said secondary dividing wall define a plurality of compartments therebetween, wherein at least one insert basket is removably inserted into one of said compartments;

wherein said insert basket has an upper band about an opening into said insert basket;

wherein said inset basket includes a generally C-shaped lifting handle having upper and lower ends, said lower end of said lifting handle being coupled to said upper band of said insert basket, said upper end of said lifting handle being positioned above said upper band of said insert basket.

9. The utensil basket of claim 8, wherein said perimeter wall has a reinforcing strip extending therearound adjacent said upper edge of said perimeter wall.

10. The utensil basket of claim 9, wherein said perimeter wall has a pair of outwardly extending generally U-shaped end handles, said end handles being coupled to said reinforcing strip of said perimeter wall.

11. The utensil basket of claim 10, wherein one of said end handles is positioned on one of said end walls, and wherein the other of said end handles is positioned on the other end wall.

12. The utensil basket of claim 8, wherein said bottom panel has a generally rectangular reinforcing lip upwardly extending therearound, and wherein said side strips are extended from said reinforcing lip of said bottom panel.

13. The utensil basket of claim 8, further comprising a tray having a generally an outer perimeter and an upwardly extending lip extending around said outer perimeter of said tray, said bottom wall being rested on said tray such that said lip of said tray is disposed around said perimeter wall.

* * * * *